US009587478B2

(12) United States Patent
Moran et al.

(10) Patent No.: US 9,587,478 B2
(45) Date of Patent: Mar. 7, 2017

(54) OPTIMIZATION OF DYNAMICALLY CHANGING DOWNHOLE TOOL SETTINGS

(75) Inventors: David P. Moran, Woodlands, TX (US); Stuart R. Oliver, Magnolia, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 523 days.

(21) Appl. No.: 13/154,921

(22) Filed: Jun. 7, 2011

(65) Prior Publication Data

US 2012/0316787 A1 Dec. 13, 2012

(51) Int. Cl.
*E21B 44/00* (2006.01)
*E21B 41/00* (2006.01)

(52) U.S. Cl.
CPC ..... *E21B 44/00* (2013.01); *E21B 2041/0028* (2013.01)

(58) Field of Classification Search
USPC .... 702/6, 9, 14, 16, 34, 35, 56, 85, 90, 105, 702/145; 175/45, 57
See application file for complete search history.

(56) References Cited

U.S. PATENT DOCUMENTS 5,730,234 A 3/1998 Putot
5,812,068 A 9/1998 Wisler et al.
5,842,149 A * 11/1998 Harrell et al. ..... 702/9
6,002,985 A 12/1999 Stephenson
6,012,015 A 1/2000 Tubel
6,021,377 A 2/2000 Dubinsky et al.
6,044,325 A 3/2000 Chakravarthy et al.
6,349,595 B1 2/2002 Civolani et al.
6,424,919 B1 7/2002 Moran et al.
6,516,293 B1 2/2003 Huang et al.
6,785,641 B1 8/2004 Huang
2003/0037964 A1 * 2/2003 Sinor et al. ..... 175/57
2005/0273302 A1 12/2005 Huang et al.
2008/0262810 A1 10/2008 Moran et al.
(Continued)

FOREIGN PATENT DOCUMENTS

GB 2434881 A 8/2007
WO 00/12859 A2 3/2000
(Continued)

OTHER PUBLICATIONS

Dekun Ma et al., "The Computer Simulation of the Interaction Between Roller Bit and Rock", SPE 29922; International Meeting on Petroleum Engineering; Beijing, PR China; Nov. 14-17, 1995; pp. 309-317 (9 pages).
(Continued)

*Primary Examiner* — Mohamed Charioui

(57) ABSTRACT

A computer-assisted method for optimizing a drilling tool assembly, the method comprising defining a desired drilling plan; determining current drilling conditions; determining current drilling tool parameters of at least two drilling tool assembly components; analyzing the current drilling conditions and the current drilling tool parameters to define a base drilling condition; comparing the base drilling condition to the desired drilling plan; determining a drilling tool parameter to adjust to achieve the desired drilling plan; and adjusting at least one drilling tool parameter of at least one of the two drilling tool assembly components based on the comparing the base drilling condition to the desired drilling plan.

17 Claims, 6 Drawing Sheets

(56) References Cited

U.S. PATENT DOCUMENTS

| | | | | |
|---|---|---|---|---|
| 2009/0090555 | A1* | 4/2009 | Boone et al. | 175/45 |
| 2009/0205822 | A1* | 8/2009 | DiFoggio et al. | 166/250.01 |

FOREIGN PATENT DOCUMENTS

| | | | |
|---|---|---|---|
| WO | 00/12860 | A2 | 3/2000 |
| WO | 2004090285 | A1 | 10/2004 |

OTHER PUBLICATIONS

T.M. Warren and A. Sinor, "Drag Bit Performance Modeling", Society of Petroleum Engineers SPE 15618, Jun. 1989; pp. 119-127 (9 pages).

T.M. Warren and W.K. Armogost, "Laboratory Drilling Performance of PDC Bits", Society of Petroleum Engineers SPE 15617, Jun. 1988, pp. 125-135 (11 pages).

Yu Wang and Matthew T. Mason, "Two-Dimensional Rigid-Body Collisions with Friction", Journal of Applied Mechanics, Sep. 1992, vol. 59, pp. 635-642 (8 pages).

Nybo, et al., "Improved and Robust Drilling Simulators Using Real-Time Measurements and Artificial Intelligence", SPE 113776—SPE EAGE Annual Conference and Exhibition, 2008, pp. 1-7.

McGraw-Hill Dictionary of Scientific and Technical Terms, "Real-Time", p. 1758, (Sybil P. Parker ed 6th Edition), McGraw-Hill: New York, 2003.

International Search Report & Written Opinion issued in PCT/US2012/040150 on Aug. 16, 2012; 7 pages.

* cited by examiner

OPTIMIZATION OF DYNAMICALLY CHANGING DOWNHOLE TOOL SETTINGS

BACKGROUND

Field of the Invention

Embodiments disclosed herein relate to methods and apparatuses for drilling wellbores. More specifically, embodiments disclosed herein relate to methods and systems for adjusting parameters of drilling tool assembly components based on determined downhole conditions. More specifically still, embodiments disclosed herein relate to methods and apparatuses for drilling wellbores using artificial neural networks to determining optimized drilling tool assembly components values.

Background Art

FIG. 1 shows one example of a conventional drilling system for drilling an earth formation. The drilling system includes a drilling rig 10 used to turn a drilling tool assembly 12 which extends downward into a wellbore 14. Drilling tool assembly 12 includes a drilling string 16, a bottom hole assembly ("BHA") 18, and a drill bit 20, attached to the distal end of drill string 16.

Drill string 16 comprises several joints of drill pipe 16*a* connected end to end through tool joints 16*b*. Drill string 16 transmits drilling fluid (through its central bore) and transmits rotational power from drill rig 10 to BHA 18. In some cases drill string 16 further includes additional components such as subs, pup joints, etc. Drill pipe 16*a* provides a hydraulic passage through which drilling fluid is pumped. The drilling fluid discharges through selected-size orifices in the bit ("jets") for the purposes of cooling the drill bit and lifting rock cuttings out of the wellbore as it is being drilled.

Bottom hole assembly 18 includes a drill bit 20. Typical BHAs may also include additional components attached between drill string 16 and drill bit 20. Examples of additional BHA components include drill collars, stabilizers, measurement-while-drilling ("MWD") tools, logging-while-drilling ("LWD") tools, and downhole motors.

In general, drilling tool assemblies 12 may include other drilling components and accessories, such as special valves, such as kelly cocks, blowout preventers, and safety valves. Additional components included in drilling tool assemblies 12 may be considered a part of drill string 16 or a part of BHA 18 depending on their locations in drilling tool assembly 12.

Drill bit 20 in BHA 18 may be any type of drill bit suitable for drilling earth formation. The most common types of earth boring bits used for drilling earth formations are fixed-cutter (or fixed-head) bits, roller cone bits, and percussion bits. FIG. 2 shows one example of a fixed-cutter bit. FIG. 3 shows one example of a roller cone bit.

Referring now to FIG. 2, fixed-cutter bits (also called drag bits) 21 typically comprise a bit body 22 having a threaded connection at one end 24 and a cutting head 26 formed at the other end. Cutting head 26 of fixed-cutter bit 21 typically comprises a plurality of ribs or blades 28 arranged about a rotational axis of the bit and extending radially outward from bit body 22. Cutting elements 29 are preferably embedded in the blades 28 to engage formation as bit 21 is rotated on a bottom surface of a wellbore. Cutting elements 29 of fixed-cutter bits may comprise polycrystalline diamond compacts ("PDC"), specially manufactured diamond cutters, or any other cutter elements known to those of ordinary skill in the art. These bits 21 are generally referred to as PDC bits.

Referring now to FIG. 3, a roller cone bit 30 typically comprises a bit body 32 having a threaded connection at one end 34 and one or more legs 31 extending from the other end. A roller cone 36 is mounted on a journal (not shown) on each leg 31 and is able to rotate with respect to bit body 32. On each cone 36, a plurality of cutting elements 38 are shown arranged in rows upon the surface of cone 36 to contact and cut a formation encountered by bit 30. Roller cone bit 30 is designed such that as it rotates, cones 36 of bit 30 roll on the bottom surface of the wellbore and cutting elements 38 engage the formation therebelow. In some cases, cutting elements 38 comprise milled steel teeth and in other cases, cutting elements 38 comprise hard metal inserts embedded in the cones. Typically, these inserts are tungsten carbide inserts or polycrystalline diamond compacts, but in some cases, hardfacing is applied to the surface of the cutting elements to improve wear resistance of the cutting structure.

Referring again to FIG. 1, for drill bit 20 to drill through formation, sufficient rotational moment and axial force must be applied to bit 20 to cause the cutting elements to cut into and/or crush formation as bit 20 is rotated. Axial force applied to bit 20 is typically referred to as the weight on bit ("WOB"). Rotational moment applied to drilling tool assembly 12 by drill rig 10 (usually by a rotary table or a top drive) to turn drilling tool assembly 12 is referred to as the rotary torque. The speed at which drilling rig 10 rotates drilling tool assembly 12, typically measured in revolutions per minute ("RPM"), is referred to as the rotary speed. Additionally, the portion of the weight of drilling tool assembly 12 supported by a suspending mechanism of rig 10 is typically referred to as the hook load.

The speed and economy with which a wellbore is drilled, as well as the quality of the hole drilled, depend on a number of factors. These factors include, among others, the mechanical properties of the rocks which are drilled, the diameter and type of the drill bit used, the flow rate of the drilling fluid, and the rotary speed and axial force applied to the drill bit. It is generally the case that for any particular mechanical property of a formation, a drill bit's rate of penetration ("ROP") corresponds to the amount of axial force on and the rotary speed of the drill bit. The rate at which the drill bit wears out is generally related to the ROP. Various methods have been developed to optimize various drilling parameters to achieve various desirable results.

Prior art methods for optimizing values for drilling parameters that primarily involve looking at the formation have focused on the compressive strength of the rock being drilled. For example, U.S. Pat. No. 6,349,595, issued to Civolani, el al. ("the '595 patent"), and assigned to the assignee of the present invention, discloses a method of selecting a drill bit design parameter based on the compressive strength of the formation. The compressive strength of the formation may be directly measured by an indentation test performed on drill cuttings in the drilling fluid returns. The method may also be applied to determine the likely optimum drilling parameters such as hydraulic requirements, gauge protection, WOB, and the bit rotation rate. The '595 patent is hereby incorporated by reference in its entirety.

U.S. Pat. No. 6,424,919, issued to Moran, et al. ("the '919 patent"), and assigned to the assignee of the present invention, discloses a method of selecting a drill bit design parameter by inputting at least one property of a formation to be drilled into a trained Artificial Neural Network ("ANN"). The '919 patent also discloses that a trained ANN may be used to determine optimum drilling operating parameters for a selected drill bit design in a formation having particular properties. The ANN may be trained using data obtained from laboratory experimentation or from existing wells that have been drilled near the present well, such as an offset well. The '919 patent is hereby incorporated by reference in its entirety.

ANNs are a relatively new data processing mechanism. ANNs emulate the neuron interconnection architecture of the human brain to mimic the process of human thought. By using empirical pattern recognition, ANNs have been applied in many areas to provide sophisticated data processing solutions to complex and dynamic problems (i.e., classification, diagnosis, decision making, prediction, voice recognition, military target identification, to name a few).

Similar to the human brain's problem solving process, ANNs use information gained from previous experience and apply that information to new problems and/or situations. The ANN uses a "training experience" (i.e., the data set) to build a system of neural interconnects and weighted links between an input layer (i.e., independent variable), a hidden layer of neural interconnects, and an output layer (i.e., the dependant variables or the results). No existing model or known algorithmic relationship between these variables is required, but such relationships may be used to train the ANN. An initial determination for the output variables in the training exercise is compared with the actual values in a training data set. Differences are back-propagated through the ANN to adjust the weighting of the various neural interconnects, until the differences are reduced to the user's error specification. Due largely to the flexibility of the learning algorithm, non-linear dependencies between the input and output layers, can be "learned" from experience.

Several references disclose various methods for using ANNs to solve various drilling, production, and formation evaluation problems. These references include U.S. Pat. No. 6,044,325 issued to Chakravarthy, et al., U.S. Pat. No. 6,002,985 issued to Stephenson, et al., U.S. Pat. No. 6,021,377 issued to Dubinsky, et al., U.S. Pat. No. 5,730,234 issued to Putot, U.S. Pat. No. 6,012,015 issued to Tubel, and U.S. Pat. No. 5,812,068 issued to Wisler, et al.

However, one skilled in the art will recognize that optimization predictions from these methods are not as accurate as simulations of drilling, which are much better equipped to make predictions for each unique situation.

Simulation methods have been previously introduced which characterize either the interaction of a bit with the bottom hole surface of a wellbore or the dynamics of BHA.

One simulation method for characterizing interaction between a roller cone bit and an earth formation is described in U.S. Pat. No. 6,516,293 ("the '293 patent"), entitled "Method for Simulating Drilling of Roller Cone Bits and its Application to Roller Cone Bit Design and Performance," and assigned to the assignee of the present invention. The '293 patent discloses methods for predicting cutting element interaction with earth formations. Furthermore, the '293 patent discloses types of experimental tests that can be performed to obtain cutting element/formation interaction data. The '293 patent is hereby incorporated by reference in its entirety. Another simulation method for characterizing cutting element/formation interaction for a roller cone bit is described in Society of Petroleum Engineers (SPE) Paper No. 29922 by D. Ma et al., entitled, "The Computer Simulation of the Interaction Between Roller Bit and Rock".

Methods for optimizing tooth orientation on roller cone bits are disclosed in PCT International Publication No. WO00/12859 entitled, "Force-Balanced Roller-Cone Bits, Systems, Drilling Methods, and Design Methods" and PCT International Publication No. WO00/12860 entitled, "Roller-Cone Bits, Systems, Drilling Methods, and Design Methods with Optimization of Tooth Orientation.

Similarly, SPE Paper No. 15618 by T. M. Warren et. al., entitled "Drag Bit Performance Modeling" discloses a method for simulating the performance of PDC bits. Also disclosed are methods for defining the bit geometry, and methods for modeling forces on cutting elements and cutting element wear during drilling based on experimental test data. Examples of experimental tests that can be performed to obtain cutting element/earth formation interaction data are also disclosed. Experimental methods that can be performed on bits in earth formations to characterize bit/earth formation interaction are discussed in SPE Paper No. 15617 by T. M. Warren et al., entitled "Laboratory Drilling Performance of PDC Bits".

What is still needed, however, is a real-time drilling simulation method which uses information gathered downhole while drilling.

SUMMARY OF THE DISCLOSURE

In one aspect, embodiments disclosed herein relate to computer-assisted method for optimizing a drilling tool assembly, the method comprising defining a desired drilling plan; determining current drilling conditions; determining current drilling tool parameters of at least two drilling tool assembly components; analyzing the current drilling conditions and the current drilling tool parameters to define a base drilling condition; comparing the base drilling condition to the desired drilling plan; determining a drilling tool parameter to adjust to achieve the desired drilling plan; and adjusting at least one drilling tool parameter of at least one of the two drilling tool assembly components based on the comparing the base drilling condition to the desired drilling plan.

In another aspect, embodiments disclosed herein relate to a computer-assisted method for optimizing a drilling tool assembly, the method comprising disposing a drilling tool assembly in a wellbore, the drilling tool assembly comprising an artificial neural network; drilling a portion of the wellbore; determining current drilling conditions and current drilling tool parameters; transmitting the current drilling conditions and current drilling tool parameters to the artificial neural network; analyzing the current drilling conditions and the current drilling tool parameters with the artificial neural network; identifying a drilling tool assembly component to adjust; determining, based on the analyzing, an optimized drilling tool parameter value for the identified drilling tool assembly component; and adjusting a drilling tool parameter of the identified drilling tool assembly component based on the determined optimized drilling tool parameter value.

In another aspect, embodiments disclosed herein relate to a drilling tool assembly comprising a first drilling tool assembly component; a second drilling tool assembly component; an artificial neutral network in communication with the first and second drilling tool assembly components, the artificial neural network comprising a processor and a storage medium, the artificial neutral network comprising instructions for: determining current drilling conditions; determining current drilling tool assembly parameters; analyzing the current drilling conditions and the current drilling tool assembly parameters; and controlling the first and second drilling tool assembly components to drill a desired wellbore.

Other aspects and advantages of the invention will be apparent from the following description and the appended claims.

DETAILED DESCRIPTION

Figure 1:
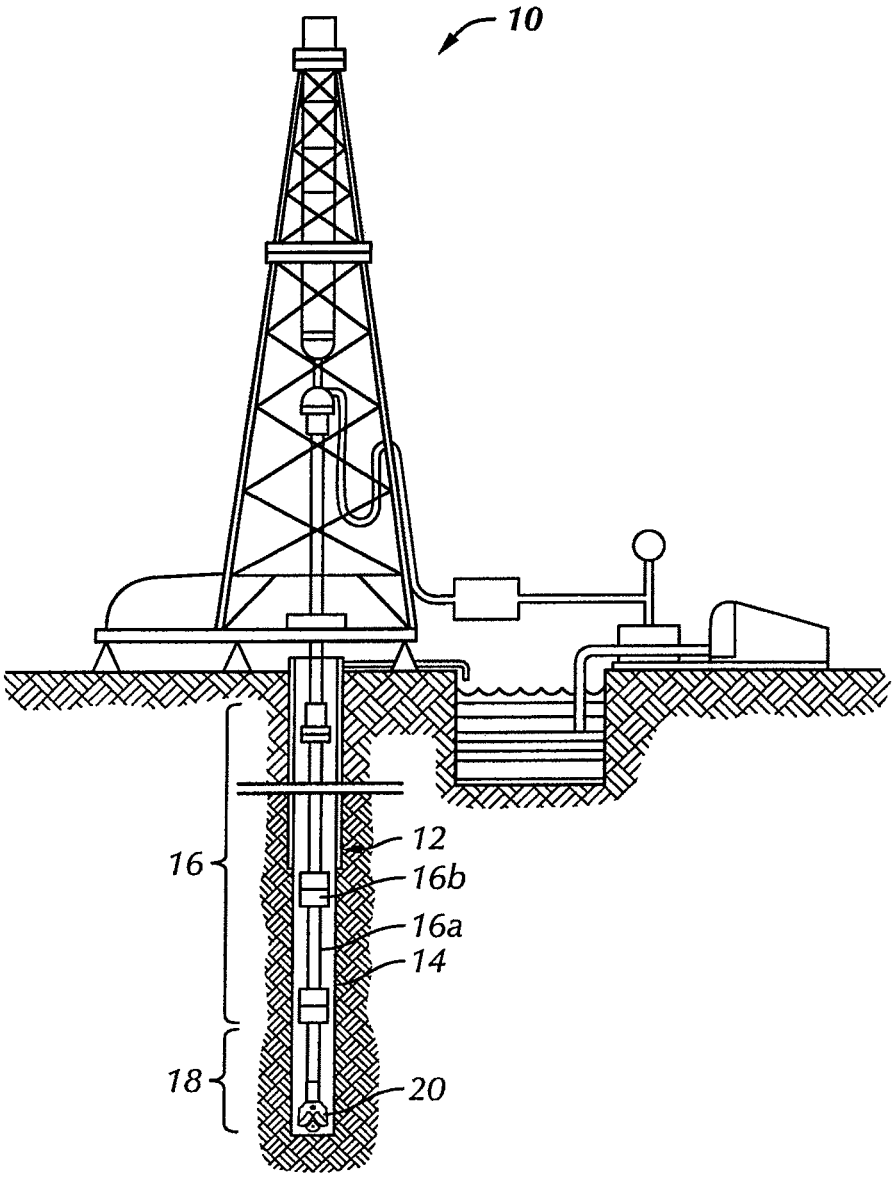
FIG. 1 is a schematic representation of a drilling tool assembly according to embodiments of the present disclosure.
Figure 2:
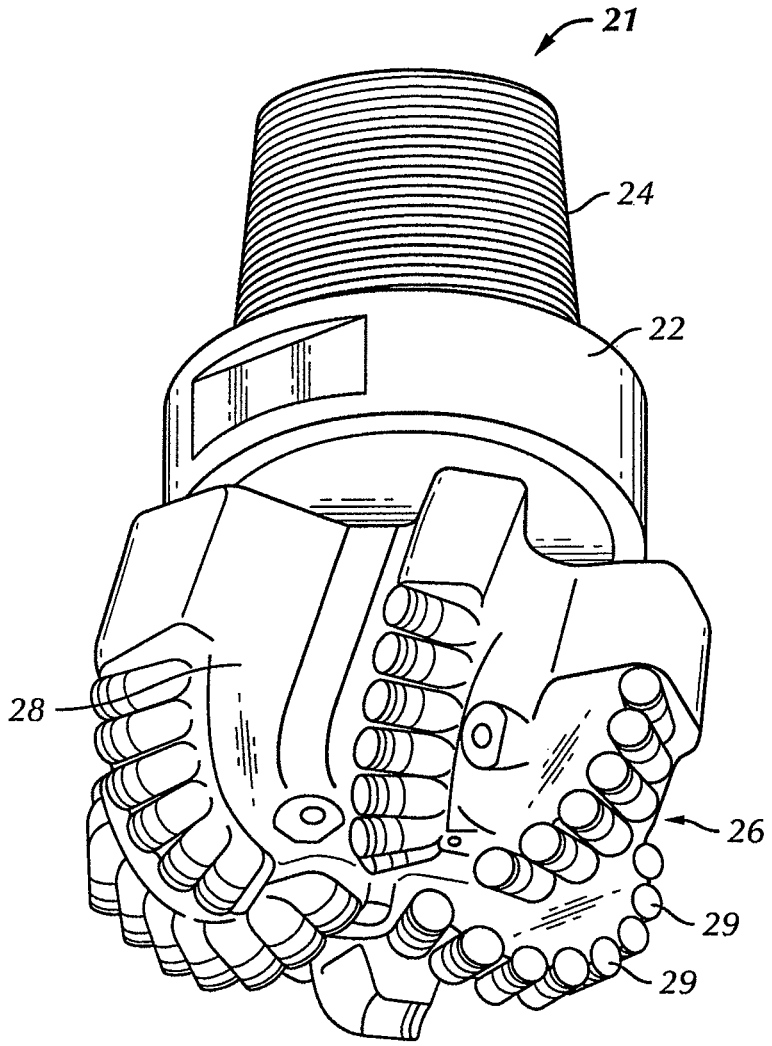
FIG. 2 is a schematic representation of a drill bit according to embodiments of the present disclosure.
Figure 3:
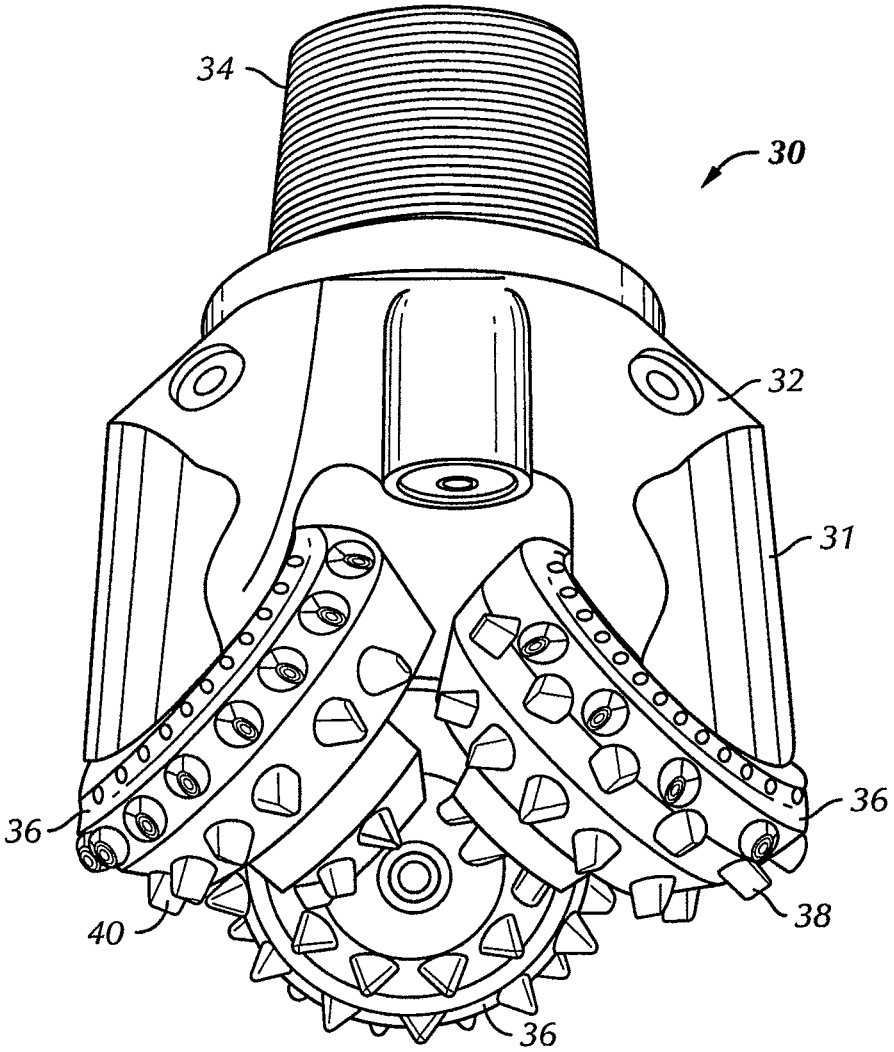
FIG. 3 is a schematic representation of a drill bit according to embodiments of the present disclosure.

In one aspect, embodiments disclosed herein relate generally to methods and apparatuses for drilling wellbores. More specifically, embodiments disclosed herein relate to methods and systems for adjusting parameters of drilling tool assembly components based on determined downhole conditions. More specifically still, embodiments disclosed herein relate to methods and apparatuses for drilling wellbores using artificial neural networks to determining optimized drilling tool assembly components values.

The term "real-time", as defined in the McGraw-Hill Dictionary Scientific and Technical Terms (6th ed., 2003), pertains to a data-processing system that controls an ongoing process and delivers its outputs (or controls its inputs) not later than the time when these are needed for effective control. In this disclosure, simulating "in real-time" means that simulations are performed with current drilling parameters on a predicted upcoming formation segment and the results are obtained before the predicted upcoming formation segment is drilled. Thus, "real-time" is not intended to require that the process is "instantaneous."

The term "current formation information" refers to information that is obtained from analyzing material samples in the formation that is being drilled. As mentioned before, the term is not limited to information from the instant formation segment being drilled, but also includes the formation segments that have already been drilled, as long as it is part of the formation that is being drilled.

The term "offset well formation information" refers to formation information that is obtained from drilling an offset well in the vicinity of the formation that is being drilled.

The term "historical formation information" refers to formation information that has been obtained prior to the start of drilling for the formation that is being drilled. It could include, for example, information related to a well drilled in the same general area as the current well, information related to a well drilled in a geologically similar area, or seismic or other survey data.

Though "offset well formation information" could qualify as "historical formation information" under the given definitions if the offset well was drilled prior to the start of drilling for the formation that is being drilled, the two terms are separated for clarity. In other words, "historical formation information" as used in this disclosure does not include the "offset well formation information," although it could conceivably include formation information from offset wells not in the vicinity of the current well.

The term "current well" is the well which is being drilled, and on which the simulation in real-time is being performed.

The term "drilling parameter" is any parameter that affects the way in which the well is being drilled. For example, the WOB is an important parameter affecting the drilling well. Other drilling parameters include the torque-on-bit ("TOB"), the rotary speed of the drill bit ("RPM"), and the mud flow rate. There are numerous other drilling parameters, as is known in the art, and the term is meant to include any such parameter.

The term "current drilling parameter" refers to a value of a drilling parameter that is being used at the moment the simulation is initiated. Of course, no information transfer is truly instantaneous, so it could also refer to a value of a drilling parameter that was used a short time before the simulation is initiated.

In downhole drilling and earth boring operations, various conditions may develop that may lead to sub-optimal drilling tool assembly life, as well as may lead to less than optimal performance of the assembly. Such detrimental conditions may result in decreased economic performance or decreased effectiveness at completing a desired operational goal.

During drilling, various sensors and measurement devices may be used to observe changing drilling conditions in real time or near real time. These measurements and observations may accumulate in the memory of downhole tools, and thereafter, some portion of the acquired data may be transmitted to surface computers for processing. The acquired measurements and/or observations may be used to process and subsequently dynamically adjust downhole tool settings in response to changing drilling conditions, thereby allowing tool properties and/or parameters to be changed if a less than optimal trend is observed.

In certain embodiments, ANNs may be used to further facilitate the processing of information gathered while drilling. ANNs may be trained in advance of use to process data using previous experience data, which may include data collected from offset wells, similar tool string configurations, like drilling environments, simulation models, or composites of similar drilling environments. In certain aspects, a trained ANN may be disposed in a downhole tool control device, and thereby receive data from on-board sensory/measurement devices, which will be explained in detail below. Using the data, the ANNs may determine trends that allow for the generation of proactive responses by controlling adjustable downhole tool elements.

In one or more embodiments, the gathering and processing of data from a drilling operation may occur in a closed loop process, and in some aspects, may occur in real time. Because the ANNs may be trained using experience data, the ANNs may be able to assess a drilling condition and adjust multiple tools to produce a desired result, e.g., reduced vibration, well path direction, mud flow, etc.

In certain circumstances, the drilling operation may be confronted with conflicting, and in certain circumstances, opposing objectives, e.g., decreasing wear while maintaining a desirable ROP. To achieve a balance of the objectives, which results in a desired performance, after the drilling tools for a particular operation are selected, the optimization process may analyze the tool and desired performance to determine optimized operating parameters to drill a particular lithologic segment at a desire ROP with minimum wear. Additionally, balance may be achieved by determining recommend parameters to maintain a planned well path trajectory, determining recommend parameters to mitigate vibrations, and determining tool settings to mitigate drilling tool assembly damage while maintaining a planned well path trajectory while maintaining a desired efficiency.

In order to further provide for optimized drilling, due to the training of the ANNs, as well as the data supplied during drilling, conflicts that arise in the balance of objectives may be resolved in a hierarchical manner so that changes to drilling tool assembly components may be determined as efficiently as possible.

Collection of Downhole Data

While drilling, it is desirable to gather as much data about the drilling process and about the formations through which the wellbore penetrates. The following description provides examples of the types of sensors that are used and the data that is collected. It is noted that in practice, it is impractical to use all of the sensors described below due to space and time constraints. In addition, the following description is not exhaustive. Other types of sensors are known in the art that may be used in connection a drilling process, and the invention is not limited to the examples provided herein.

The first type of data that is collected may be classified as near instantaneous measurements, often called "rig sensed data" because it is sensed on the rig. These include the WOB and the TOB, as measured at the surface. Other rig sensed data include the RPM, the casing pressure, the depth of the drill bit, and the drill bit type. In addition, measurements of the drilling fluid ("mud") are also taken at the surface. For example, the initial mud condition, the mud flow rate, and the pumping pressure, among others. All of these data may be collected on the rig at the surface, and they represent the drilling conditions at the time the data are available.

Other measurements are taken while drilling by instruments and sensors in the BHA. These measurements and the resulting data are typically provided by an oilfield services vendor that specializes in making downhole measurements while drilling. The invention, however, is not limited by the party that makes the measurements or provides the data.

As described above in reference to FIG. 1, a drill string 16 typically includes a BHA 18 that includes a drill bit 20 and a number of downhole tools. Downhole tools may include various sensors for measuring the properties related to the formation and its contents, as well as properties related to the wellbore conditions and the drill bit. In general, "logging-while-drilling" ("LWD") refers to measurements related to the formation and its contents. "Measurement-while-drilling" ("MWD"), on the other hand, refers to measurements related to the wellbore and the drill bit. The distinction is not germane to the present invention, and any reference to one should not be interpreted to exclude the other.

LWD sensors located in BHA may include, for example, one or more of a gamma ray tool, a resistivity tool, an nuclear magnetic resonance tool, a sonic tool, a formation sampling tool, a neutron tool, and electrical tools. Such tools are used to measure properties of the formation and its contents, such as, the formation porosity, formation permeability, density, lithology, dielectric constant, formation layer interfaces, as well as the type, pressure, and viscosity of the fluid in the formation.

One or more MWD sensors may also be located in BHA 18. MWD sensors may measure the loads acting on the drill string, such a WOB, TOB, and bending moments. It is also desirable to measure the axial, lateral, and torsional vibrations in the drill string. Other MWD sensors may measure the azimuth and inclination of the drill bit, the temperature and pressure of the fluids in the wellbore, as well as properties of the drill bit such as bearing temperature and grease pressure.

The data collected by LWD/MWD tools is often relayed to the surface before being used. In some cases, the data is simply stored in a memory of the tool and retrieved when the tool is brought back to the surface. In other cases, LWD/MWD data may be transmitted to the surface using known telemetry methods.

Telemetry between the BHA and the surface, such as mud-pulse telemetry, may be slow and only enable the transmission of selected information. Because of the slow telemetry rate, all the data from LWD/MWD tools may not be available at the surface for several minutes after the data is collected. In addition, the sensors in a BHA 18 may be located behind the drill bit, by as much as fifty feet. Thus, the data received at the surface may be slightly delayed due to the telemetry rate that the position of the sensors in the BHA.

Other measurements are made based on lagged events. For example, drill cuttings in the return mud may be analyzed to gain more information about the formation that is drilled. During the drilling process, the drill cuttings are transported to the surface in the mud flow through an annulus formed between drill string 16 and wellbore 14. In a deep well, for example, drill bit 20 may drill an additional 50 to 100 feet while drill cuttings travel to the surface. Thus, the drill bit continues to advance an additional distance while the drilled cuttings from the depth position of interest are transported to the surface in the mud circulation system. Therefore, the data may be lagged by at least the time to circulate the cuttings to surface.

Analysis of the drill cuttings and the returning drilling mud may provide additional information about the formation and its contents. For example, the formation lithology, compressive strength, shear strength, abrasiveness, and conductivity may be measured. Measurements of the returning drilling mud temperature, density, and gas content may also yield data related to the formation and its contents.

Transmission of Downhole Data

In order to transmit information about downhole conditions, as well as drilling tool assembly component parameters, various information transmission techniques may be used. In one embodiment, the drilling tool assembly may comprise an intelligent drill string system. One commercially available intelligent drill string system that may be useful in this application is a IntelliServ® network available from Grant Prideco (Houston, Tex.). An intelligent drill string system may comprise high-speed data cable encased in a high-pressure conduit that runs the length of each tubular. The data cable ends at inductive coils that may be installed in the connections of each end of a tubular joint. The intelligent drill string system provides high-speed, high-volume, bi-directional data transmission to and from hundreds of discrete measurement nodes. The intelligent drill string system may provide data transmission rates of up to 2 megabits/sec. Accordingly, transmission of data at high speeds supports high resolution MWD/LWD tools and provides instantaneous control of down-hole mechanical devices, for example, expandable stabilizers. Each device may be defined as a node with a unique address and may gather or relay data from a previous node onto a next node. The flow of information between devices may be controlled, for example, by network protocol software and hardware. Because each node is uniquely identifiable, the location where events occur along the length of the well can be determined and modeled. Data may be transmitted both upwards and downwards from the measurement nodes, regardless of circulation conditions, thereby allowing transmission of downhole data to the surface, transmission of commands from the surface to downhole devices, and transmission of commands between downhole devices.

In other embodiments, information may be transmitted between various components of the drilling tool assembly and/or to the surface through LWD and MWD devices, wireline devices, proprietary conduits, and other methods of transmitting data in a wellbore bore environment that maybe known to those of ordinary skill in the art.

Training Artificial Neural Networks

To train the ANN to determine formation properties, a training data set may include known input variables (representing well data, e.g., previously acquired data) and known output variables (representing the formation properties corresponding to the well data). After training, an ANN may be used to determine unknown formation properties based on measured well data. For example, raw current well data may be input to a computer with a trained ANN. Then, using the trained ANN and the current well data, the computer may output estimations of the formation properties.

Additionally, predicting formation properties may be performed by a trained ANN. In such embodiments, the ANN may be trained using a training data set that includes the previously acquired data and the correlation of well data to offset well data as the inputs and known next segment formation properties as the outputs. Using the training data set, the ANN may build a series of neural interconnects and weighted links between the input variables and the output variables. Using this training experience, an ANN may then predict unknown formation properties for the next segment based on inputs of previously acquired data and the correlation of the current well data to the previously acquired data.

Defining a Drilling Tool Assembly and a Drilling Plan

In order to allow an ANN to analyze a drilling tool assembly including the various components disposed thereon, it may be necessary to mathematically define components of the drilling tool assembly. For example, the drill string may generally be defined in terms of geometric and material parameters, such as the total length, the total weight, inside diameter ("ID"), outside diameter ("OD"), and material properties of the various components of the drill string. Material properties of the drill string components may include the strength, and elasticity of the component material. Each component of the drill string may be individually defined or various parts may be defined in the aggregate. For example, a drill string comprising a plurality of substantially identical joints of drill pipe may be defined by the number of drill pipe joints of the drill string, and the ID, OD, length, and material properties for one drill pipe joint. Similarly, the BHA may be defined in terms of parameters, such as the ID, OD, length, and material properties of one drill collar and of any other component that makes up the BHA.

The geometry and material properties of the drill bit also need to be defined as required for the method selected for simulating drill bit interaction with the earth formation at the bottom surface of the wellbore. One example of a method for simulating a roller cone drill bit drilling an earth formation can be found in the previously mentioned U.S. Pat. No. 6,516,293, assigned to the assignee of the present invention, and incorporated herein by reference in its entirety.

In addition to defining the properties of the drilling tool assembly components, known properties about the wellbore, including wellbore trajectory, in which the drilling tool assembly is to be confined, also needs to be defined, along with an initial wellbore bottom surface geometry. Because the wellbore trajectory may be straight, curved, or a combination of straight and curved sections, wellbore trajectories, in general, may be defined by defining parameters for each segment of the trajectory. For example, a wellbore comprising N segments may be defined by the length, diameter, inclination angle, and azimuth direction of each segment and an indication of the order of the segments (i.e., first, second, etc.). Wellbore parameters defined in this manner can then be used to mathematically produce a model of the entire wellbore trajectory. Formation material properties along the wellbore may also be defined and used. Additionally, drilling operating parameters, such as the speed at which the drilling tool assembly is rotated and the hook load also need to be defined.

Interaction between the drilling tool assembly and the drilling environment may include interaction between the drill bit at the end of the drilling tool assembly and the formation at the bottom of the wellbore. Interaction between the drilling tool assembly and the drilling environment also may include interaction between the drilling tool assembly and the side (or wall) of the wellbore. Further, interaction between the drilling tool assembly and drilling environment may include viscous damping effects of the drilling fluid on the dynamic response of the drilling tool assembly. In addition to the interaction of the drill bit, various other components interact with the drilling environment, and may include properties that may be adjustable. Examples of other drilling tool assembly components may include secondary cutting structure, such as reamers, stabilizers, LWD devices, MWD devices, telemetry devices, etc.

Various parameters may also be defined, adjusted, and/or calculated as a well is drilled. Below is a list of various drill string parameters, BHA parameters, drill bit parameters, drilling environment parameters, operating parameters, drilling tool assembly/drilling environment interaction parameters, cutting element/formation interaction parameters, and drilling tool assembly/formation parameters that may require defining prior to analysis by an ANN, as well as parameters that may be adjusted in response to a particular drilling condition as determined through the collection of downhole data.

Drill string design parameters may include, for example, the length, ID, OD, weight (or density), and other material properties of the drill string in the aggregate. Alternatively, drill string design parameters may include the properties of each component of the drill string and the number of components and location of each component of the drill string. For example, the length, ID, OD, weight, and material properties of one joint of drill pipe may be provided along with the number of joints of drill pipe which make up the drill string. Material properties used may include the type of material and/or the strength, elasticity, and density of the material. The weight of the drill string, or individual components of the drill string may be provided as "weight in drilling fluids" (the weight of the component when submerged in the selected drilling fluid of a given density).

BHA design parameters may include, for example, the bent angle and orientation of the motor, the length, equivalent ID, OD, weight (or density), and other material properties of each of the various components of the BHA. In this example, the drill collars, stabilizers, and other downhole tools are defined by their lengths, equivalent IDs, ODs, material properties, weight in drilling fluids, and position in the drilling tool assembly.

Drill bit design parameters may include, for example, the bit type (roller cone, fixed-cutter, etc.) and geometric parameters of the bit. Geometric parameters of the bit may include the bit size (e.g., diameter), number of cutting elements, and the location, shape, size, and orientation of the cutting elements. In the case of a roller cone bit, drill bit design parameters may further include cone profiles, cone axis offset (offset from perpendicular with the bit axis of rotation), the number of cutting elements on each cone, the location, size, shape, orientation, etc. of each cutting element on each cone, and any other bit geometric parameters (e.g., journal angles, element spacings, etc.) to completely define the bit geometry. In general, bit, cutting element, and cone geometry may be converted to coordinates and provided as input. One preferred method for obtaining bit design parameters is the use of three-dimensional CAD solid or surface models to facilitate geometric input. Drill bit design parameters may further include material properties, such as strength, hardness, etc. of components of the bit.

Initial drilling environment parameters may include, for example, wellbore parameters. Wellbore parameters may include wellbore trajectory (or geometric) parameters and wellbore formation parameters. Wellbore trajectory parameters may include an initial wellbore measured depth (or length), wellbore diameter, inclination angle, and azimuth direction of the wellbore trajectory. In the typical case of a wellbore comprising segments having different diameters or differing in direction, the wellbore trajectory information may include depths, diameters, inclination angles, and azimuth directions for each of the various segments. Wellbore trajectory information may further include an indication of the curvature of the segments (which may be used to determine the order of mathematical equations used to represent each segment). Wellbore formation parameters may include the type of formation being drilled and/or material properties of the formation such as the formation strength, hardness, plasticity, and elastic modulus.

Drilling operating parameters may include the rotary table speed at which the drilling tool assembly is rotated (RPM), the downhole motor speed if a downhole motor is included, and the hook load. Drilling operating parameters 206 may further include drilling fluid parameters, such as the viscosity and density of the drilling fluid, for example. It should be understood that drilling operating parameters 206 are not limited to these variables. In other embodiments, drilling operating parameters 206 may include other variables, such as, for example, rotary torque and drilling fluid flow rate. Additionally, drilling operating parameters 206 for the purpose of simulation may further include the total number of bit revolutions to be simulated or the total drilling time desired for simulation. However, it should be understood that total revolutions and total drilling time are simply end conditions that can be provided as input to control the stopping point of simulation, and are not necessary for the calculation required for simulation. Additionally, in other embodiments, other end conditions may be provided, such as total drilling depth to be simulated, or by operator command, for example.

Drilling tool assembly/drilling environment interaction information may include, for example, cutting element/earth formation interaction models (or parameters) and drilling tool assembly/formation impact, friction, and damping models and/or parameters. Cutting element/earth formation interaction models may include vertical force-penetration relations and/or parameters which characterize the relationship between the axial force of a selected cutting element on a selected formation and the corresponding penetration of the cutting element into the formation. Cutting element/earth formation interaction models may also include lateral force-scraping relations and/or parameters which characterize the relationship between the lateral force of a selected cutting element on a selected formation and the corresponding scraping of the formation by the cutting element.

Cutting element/formation interaction information may also include brittle fracture crater models and/or parameters for predicting formation craters which will likely result in brittle fracture, wear models and/or parameters for predicting cutting element wear resulting from contact with the formation, and cone shell/formation or bit body/formation interaction models and/or parameters for determining forces on the bit resulting from cone shell/formation or bit body/formation interaction. One example of methods for obtaining or determining drilling tool assembly/formation interaction models or parameters can be found in previously noted U.S. Pat. No. 6,516,293. Other methods for modeling drill bit interaction with a formation can be found in the previously noted SPE Papers No. 29922, No. 15617, and No. 15618, and PCT International Publication Nos. WO 00/12859 and WO 00/12860.

Drilling tool assembly/formation information/parameters may include impact, friction, and damping models and/or parameters that characterize impact and friction on the drilling tool assembly due to contact with the wall of the wellbore and the viscous damping effects of the drilling fluid. These parameters include, for example, drill string-BHA/formation impact models and/or parameters, bit body/formation impact models and/or parameters, drill string-BHA/formation friction models and/or parameters, and drilling fluid viscous damping models and/or parameters. One skilled in the art will appreciate that impact, friction and damping models/parameters may be obtained through laboratory experimentation, in a method similar to that disclosed in the prior art for drill bits interaction models/parameters. Alternatively, these models may also be derived based on mechanical properties of the formation and the drilling tool assembly, or may be obtained from literature. Prior art methods for determining impact and friction models are shown, for example, in papers such as the one by Yu Wang and Matthew Mason, entitled "Two-Dimensional Rigid-Body Collisions with Friction", Journal of Applied Mechanics, September 1992, Vol. 59, pp. 635-642.

Optimizing Drilling Tool Assembly Operation

Figure 4:
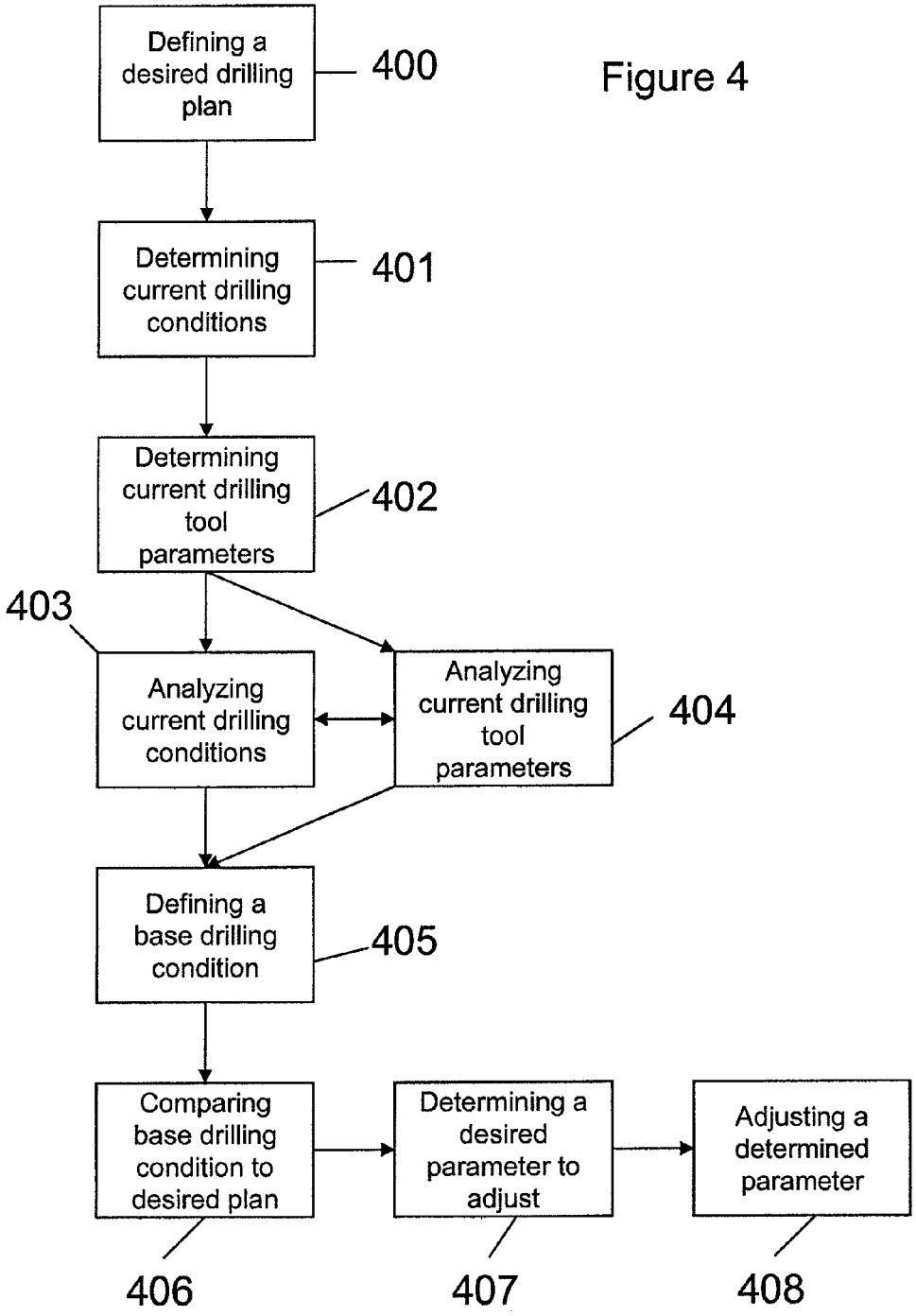
FIG. 4 is a flow chart of a method for optimizing a downhole drilling tool assembly according to embodiments of the present disclosure.

Referring to FIG. 4, a flow chart of a method for optimizing drilling tool assembly operation according to embodiments of the present disclosure is shown. During the drilling of a wellbore, it may be beneficial to optimize the settings of various components both individually and in relation to one another. As the drilling environment changes, the operational parameters of various components may be monitored, simulated, and subsequently adjusted so as to provide more efficient or desirable drilling.

Initially, a desired drilling plan is defined 400. A desired drilling plan may include a plan to reach a particular producing formation, or in other embodiments may refer to a particular portion of a wellbore. Those of ordinary skill in the art will appreciate that depending on the requirements of a particular drilling operation, the drilling plan may be adjusted based on a change in environmental information. To define a drilling plan 400, a drilling engineer determines the distance to a producing formation, or otherwise determines aspects of a particular segment, including expected length of the segment. The drilling engineer may also define a drilling plan in terms of expected formation type, size of the wellbore, expected drilling time, drilling cost, expected drilling tool assembly components, expected drilling fluids and fluid additives, etc.

When the drilling plan is defined, the plan may be loaded into a computer program or saved into media disposed on a component of a drilling tool assembly, such as a component in operative communication with an ANN. In certain embodiments the drilling plan may be used to train an ANN in circumstances where the drilling plan includes experience data, such as data gathered from offset wells or prior simulations. In other embodiments, the drilling plan information may be saved so as to be interpreted and modified during drilling.

With a defined drilling plan 400 in place, drilling engineers may then proceed with drilling a well. During well drilling, as explained above, information about current drilling conditions may be determined 401. The determination of drilling conditions may include gathering data about individual drilling tool assembly components, as well as gathering data about the drilling environment. In certain embodiments, data may be gathered through the use of LWD and MWD drilling tools. Such tools may be used to determine the condition of the drilling environment, including information about formation parameters, such as, for example, resistivity, porosity, sonic velocity, gamma ray, etc.

The determined conditions 401 may then be transmitted to a downhole storage media in communication with one or more ANNs for analysis. In addition to determining current drilling conditions 401, current drilling tool parameters may also be determined 402. Information may be gathered about drilling tool parameters by sending signals to individual components of a drilling tool assembly to request information, such as, for example, orientation of a tool, whether a tool is active or inactive, whether a tool is engaged with formation, the acceleration of a tool, the vibration signature of a tool, the temperature of a tool, etc. For example, in one embodiment, a signal requesting current tool parameters may be sent requesting information regarding the orientation of a drill bit and whether a secondary cutting structure is active. This information may then be stored on media in operative communication with an ANN. In other embodiments, information may be supplied from the surface to a storage media in operative communication with an ANN. For example, in such an embodiment, an operator may supply information to an ANN indicating that a drill bit drilling along a particular trajectory with a secondary cutting structure, such as a reamer, is actively drilling formation. In still other embodiments, information about the wellbore or drilling tool assembly may be supplied downhole directly to the ANN, while other information is supplied from a drilling engineer.

As the ANNs are populated with current drilling condition and current drilling tool parameter data, the data may be used to analyze current drilling conditions 403, as well as analyze current drilling tool parameters 404. The processes of analyzing 403, 404 the supplied data may include processing the data using an ANN to determine how a particular drilling tool parameter in a particular environment may affect the outcome of the drilling. The ANN may run multiple scenarios interpreting the data in order to define a base drilling condition 405.

The base drilling condition may include a starting point for the ANN to determine whether the current drilling tool parameters in the current drilling conditions, as determined in steps 401,402 allow drilling to progress according to the defined desired drilling plan 400. In certain circumstances, the base drilling condition may be acceptable. An example of a base drilling condition that is acceptable may include a drilling plan that results in drilling along a particular trajectory at a desired ROP with acceptable wear. However, in certain circumstances, the defined base drilling condition 405 does not fall within acceptable bounds so as to match the desired drilling plan.

In order to determine whether the parameters of one or more drilling tool assembly components should be adjusted, the based drilling plan is compared 406 to the desired drilling plan. The comparison 406 of the drilling plans may include determining whether the base drilling plan results in an expected ROP, vibration signature, wellbore trajectory, and/or wear pattern. In certain embodiments, the defined drilling plan 400 may include variance ranges, thereby allowing the ANN to determine if the base drilling condition is within an acceptable range of a desired drilling plan. For example, a drilling engineer may allow for a variance of ROP within 20 percent of plan, while requiring the trajectory be within 5 percent of plan. In certain aspects, the drilling plan may also provide for a maximum or minimum acceptable response. For example, the drilling plan may indicate that vibrations over a particular value are not acceptable or a ROP under a particular value are not acceptable. Thus, an ANN may include pre-defined data allowing the ANN to determine whether the base drilling plan is acceptable based on the defined desired drilling plan 400.

In certain circumstances the base drilling plan may be within acceptable ranges. In such circumstances, the ANN may recommend no changes to parameters. However, in certain circumstances, the ANN may determine that the base drilling condition is not acceptable, thereby warranting adjusting an aspect of drilling. In still other circumstances, the ANN may determine that the base drilling plan is acceptable, but not optimized. In such circumstances, the ANN may recommend adjusting one or more aspects of drilling in order to further optimize the drilling operation.

Prior to adjusting a parameter, the ANN may determine a desired parameter to adjust 407. In certain aspects, the ANN may determine 407 multiple parameters to adjust, as the affect of adjusting one parameter may result in the need to adjust other parameters of other components of the drilling tool assembly. For example, during the determining step 407, the ANN may analyze various changes to parameters of the drilling operation, determine the affect of a change on the resultant drilling, then determine whether the change resulted in a net positive outcome or a net negative outcome (e.g., more efficient drilling condition). The ANN may continue this analytic sequence until an optimized set of adjustments is determined 407.

Because ANNs may provide for adaptive responses as a result of added external information (current drilling conditions and current drilling tool parameters), the ANNs may find patterns in the data, based on the original experience data as modified by the changing external information, thereby allowing the ANN to learn from the provided external data. In certain embodiments, the ANN may also include algorithms allowing for adaptive and/or reinforcement learning that occurs as a result of continuous or near continuous data representative of interactions between drilling tool assembly components and the drilling environment.

Because ANNs generally provide non-linear modeling, the ANNs may be used to determine the affect on adjusting a parameter of a drilling tool assembly component on other components, as well as the drilling operation in general. For the same reason, ANNs may allow for the simultaneous or near simultaneous modeling of changing various drilling tool assembly components and the relative effects of the changes on one or more components of the drilling tool assembly, as well as the drilling operation in general.

The process of drilling, as explained above, is often confronted with conflicting and opposing objectives, e.g., whether to select a high ROP that may result in high wear. In order to balance the objectives of drilling that result in a desired drilling efficiency, operational parameters for a drilling tool assembly may be hierarchically defined. The primary concerns during drilling include determining operating parameters that allow for drilling a particular lithologic segment at the fastest ROP with minimum cutting structure wear, determining recommended operating parameters to maintain a planned well path trajectory, determining recommended parameters to mitigate destructive vibration, and determining adjustable tool settings to mitigate drilling assembly damage while maintaining desired well path trajectories and allow drilling in an efficient manner.

Using non-linear modeling, the ANNs may thereby allow for the primary concerns to be addressed sequentially, or in parallel, thereby allowing for multiple drilling tool component parameters to be analyzed with respect to one another. In certain embodiments, a drilling plan may include an indication that when analyzing determining a desired parameter to adjust, the primary concern should be determining a drilling tool parameter to adjust in order to drill a segment of a wellbore with an optimized/faster ROP. In other drilling operations, the drilling plan may indicate that one of the other primary concerns should be analyzed first, or a different primary concern should be afforded greater weight in determining which parameter(s) to adjust.

Using the primary concerns identified above, the ANN may then process the analyzed drilling conditions and drilling tool parameters to determine 407 a drilling tool parameter to adjust to achieve the desired drilling plan. At least one drilling tool parameter of at least one drilling tool assembly component may then be adjusted 408, based on the comparison of the base drilling condition to the desired drilling plan. In certain circumstances, at least one drilling tool assembly parameter of at least two drilling tool assembly components may be adjusted. Because the effects of adjusting one drilling tool typically results in a change to the operation of at least one other drilling tool component, and because the relative affects of adjustments to various drilling tool components are accounted for during the determining 407 a parameter to adjust, such adjustments 408 may be made at the same time, or nearly the same time. By adjusting 408 multiple drilling tool assembly component parameters at the same or nearly same time, destructive damage that may occur in between adjustment periods may be avoided. Thus, instead of changing a parameter value, then redetermining the effect on the tool or drilling due to the change (which occurs using linear modeling), the values for an optimized drilling tool assembly may be changed at substantially the same time.

Because the ANNs may constantly receive updated data on drilling conditions, the ANNs may continuously determine changes to drilling tool assembly components that result in further optimized drilling. Thus, if a variable of the drilling plan is no longer within an acceptable range, a corrective action may be recommended or implemented as a result of the continuous ANN analysis. Additionally, because the ANN receives updated data, the data may be processed and parameters may be adjusted in real or near real time.

Figure 5:
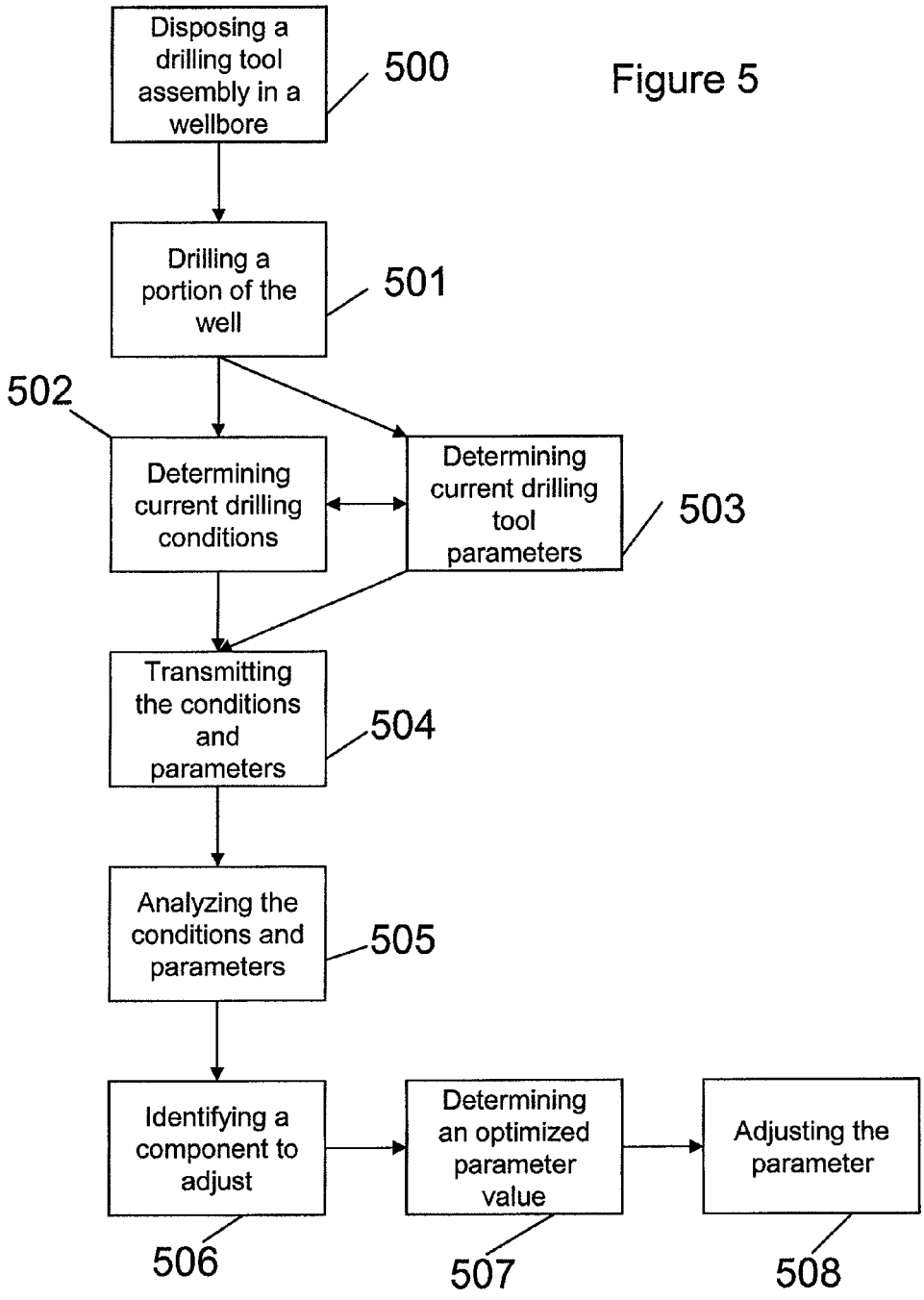
FIG. 5 is a flow chart of an alternative method for optimizing a downhole drilling tool assembly according to embodiments of the present disclosure.

Referring to FIG. 5, a method for optimizing a drilling tool assembly according to embodiments of the present disclosure is shown. In this embodiment, a portion of a wellbore may be drilled prior to optimization of a drilling tool assembly. Thus, a drilling tool assembly may be initially disposed 500 in a wellbore. Using the disposed 500 drilling tool assembly, a portion of the well may be drilled 501. During the drilling, downhole conditions may be determined 502 using LWD and MWD devices, as explained above. This data may be stored in media, either downhole or at the surface, so that the data may be inputted into or accessed by an ANN. Additionally, current drilling tool parameters may be determined 503, thereby allowing changes to the drilling tool parameters to be monitored and taken into consideration by the ANN during analysis.

As the current drilling conditions and current tool parameters are determined 502, 503, the data may be transmitted 504 to an ANN. In order to facilitate the real or near real time transmittance of the data transmission tools, such as an intelligent drill string may be used. The ANN may then analyze 505 the current drilling conditions and the current drilling tool parameters, and identify 506 a drilling tool assembly component to adjust. In identifying 506 a drilling tool assembly component to adjust, a process similar to that used for determining a drilling tool parameter, with respect to FIG. 4, may be used. For example, a drilling tool assembly component may be identified based on a hierarchical approach to determining the tool that is most likely to cause either a net negative condition or a net positive condition. The tool may then be analyzed individually, or with respect to other drilling tool assembly components, to determine the effect of adjusting a parameter of the drilling tool on itself, other drilling tool assembly components, or drilling in general. After the drilling tool to be adjusted is identified 506, a parameter value to achieve an optimized drilling tool assembly component is determined 507.

As with identifying 506 the component to adjust, the value of the parameter of the identified tool to adjust may also be processed by an ANN by looking at the effect on adjusting the parameter relative to the tool itself, as well as other components of the drilling tool assembly and drilling in general. After the parameter value to adjust is determined 507, the parameter may be adjusted 508 by transmitting a signal to the tool to be adjusted. Additionally, in certain embodiments, the ANN may identify multiple tools to be adjusted in order to result in a desired drilling condition. In such embodiments, at lest one drilling tool parameter of at least two drilling tool assembly components may be adjusted based on a comparison of the two drilling tool assembly components.

As with the embodiments described above, identification of a component to adjust, as well as determination of a value to adjust and the actual adjustment may occur in real or near real time, as the ANN may consistently generate updated models based on changing drilling conditions and tool conditions.

In certain embodiments, a drilling tool assembly may include a first drilling tool assembly component and a second drilling tool assembly component. The drilling tool assembly may further include an ANN in communication with the first and second drilling tool assembly components, in which the ANN includes a processor and a storage medium. The ANN may further include instructions for determining current drilling conditions, determining current drilling tool assembly parameters, analyzing current drilling conditions and current drilling tool assembly parameters, and controlling the first and second drilling tool assembly components to drilling a desired wellbore.

Determining current drilling conditions and determining current drilling tool assembly parameters may not be determined solely by the ANN, rather, the ANN may receive input data from one or more devices gathering such data. As explained above, the data may be gathered by LWD devices, MWD devices, or from other individual components/devices, thereby providing data on a continuous or near continuous basis to the ANN. In other embodiments, the data may be supplied in batches or at given time increments.

The determined data, in certain embodiments, may be stored in a storage media for access at a later time. In alternate embodiments, the data may be inputted to the ANN in real or near real time, thereby allowing the data to be processed as close in time as possible to when the data was collected. In order to facilitate the processing of data, the data may be transferred to the ANN and/or storage media through an intelligent drill string or other connection that allows for the transmission of data at high rates of speed.

The ANN may be operatively connected to various components of the drilling tool assembly through an intelligent drill string, or other means, thereby allowing the multiple components of the drilling tool assembly to be controlled as data is analyzed. Thus, as data is collected and analyzed in near real time, components of the drilling tool assembly may be controlled in near real time. Control in near real time may thereby allow a drilling tool assembly to be adjusted based on changes in the drilling environment, thereby allowing drilling to progress according to a predetermined drilling plan. Additionally, because the drilling tool assembly components may be controlled in near real time, the drilling tool assembly components may be adjusted so as to avoid conditions that may result in wear to the components, such as damaging vibrational signatures.

Further, those skilled in the art will appreciate that one or more elements of the aforementioned computer system may be located at a remote location and connected to the other elements over a network. Further, embodiments of the present disclosure may be implemented on a distributed system having a plurality of nodes, where each portion of the present disclosure (e.g., the local unit at the rig location or a remote control facility) may be located on a different node within the distributed system.

Figure 6:
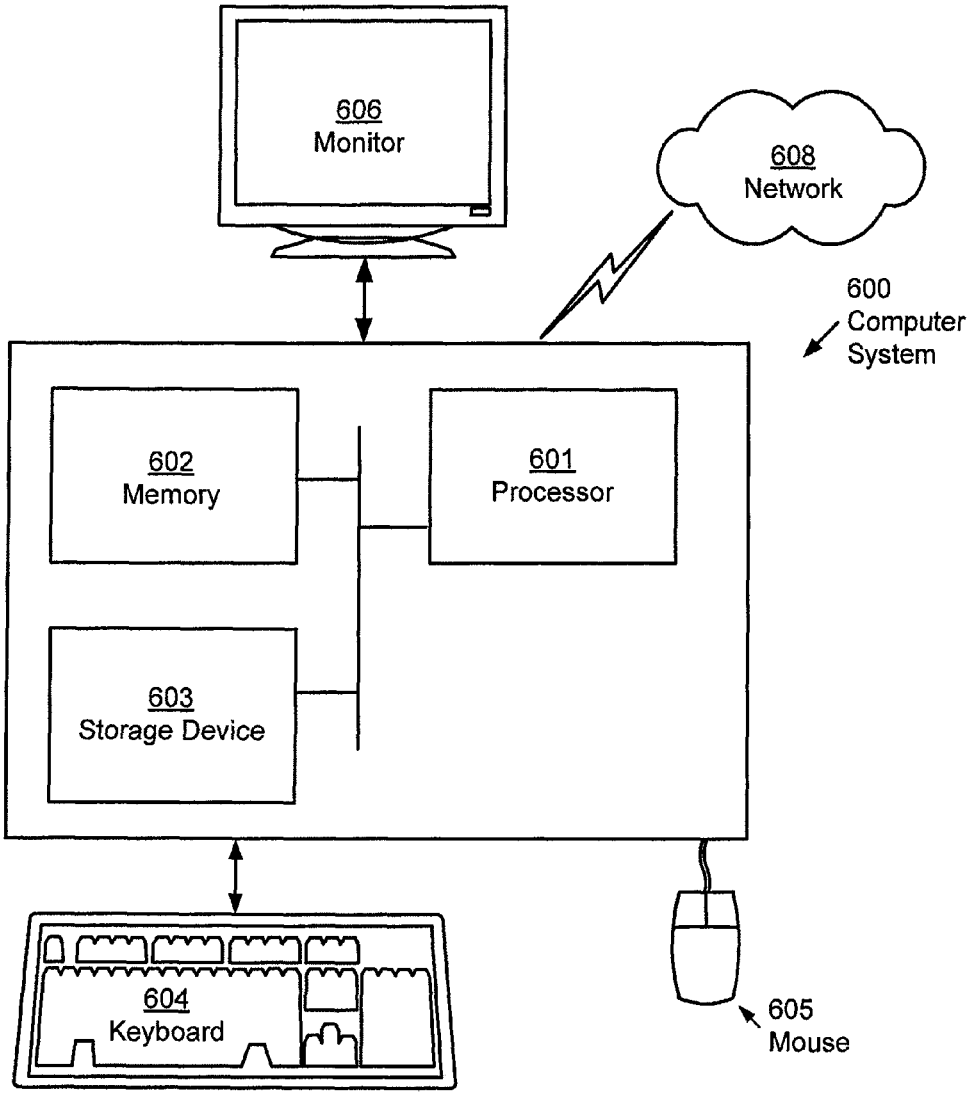
FIG. 6 is a schematic representation of a computer system according to embodiments of the present disclosure.

Referring to FIG. 6, a schematic representation of a computer system according to embodiments of the present disclosure is shown. A computer system 600, which may be used in accordance with embodiments of the present disclosure, may include a processor 601 for executing applications and software instructions configured to perform various functionalities, and memory 602 for storing software instructions and application data. Software instructions to perform embodiments of the invention may be stored on any tangible computer readable medium such as a compact disc (CD), a diskette, a tape, a memory stick such as a jump drive or a flash memory drive, or any other computer or machine readable storage device 603 that can be read and executed by the processor 601 of the computing device. The memory 602 may be flash memory, a hard disk drive (HDD), persistent storage, random access memory (RAM), read-only memory (ROM), any other type of suitable storage space, or any combination thereof.

The computer system 600 may also include input means, such as a keyboard 604, a mouse 605, or other input device (not shown). Further, the computer system 600 may include output means, such as a monitor 606 (e.g., a liquid crystal display (LCD), a plasma display, or cathode ray tube (CRT) monitor). The computer system 600 may be connected to a network 608 (e.g., a local area network (LAN), a wide area network (WAN) such as the Internet, or any other similar type of network) via a network interface connection (not shown). Those skilled in the art will appreciate that many different types of computer systems 600 exist, and the aforementioned input and output means may take other forms. Generally speaking, the computer system 600 includes at least the minimal processing, input, and/or output means necessary to practice embodiments of the invention.

The computer system 600 is typically associated with a user/operator using the computer system 600. For example, the user may be an individual, a company, an organization, a group of individuals, or another computing device, such as an ANN. In one or more embodiments of the invention, the user is a drill engineer that uses the computer system 600 to remotely access a fluid analyzer located at a drilling rig.

Advantageously, embodiments of the present disclosure may provide methods and apparatus for optimizing drilling tool assembly component parameters, such as tool position settings, in response to observed downhole drilling conditions. Also advantageously, because ANNs may be used to analyze changing downhole conditions, multiple components may be analyzed with respect to one another, thereby allowing for multiple drilling tool assembly component parameters to be adjusted based on changes to the drilling environment.

Advantageously, embodiments of the present disclosure may provide for a hierarchical optimization process that allows for conflicts in drilling concerns to be resolved, thereby allowing for a more efficient drilling operation. Because the concerns may be address hierarchically, drilling tool assembly components may be adjusted, thereby allowing for ROP, wear, trajectory, and vibration concerns to be balanced, resulting in efficient drilling.

Also advantageously, ANNs in accordance with embodiments of the present disclosure may be disposed in a downhole assembly where the ANNs may receive data, thereby allowing the ANNs to assess apparent trends from the data and generate proactive responses to changes in downhole conditions. Because the analysis process may occur in real time, embodiments of the present disclosure may allow for changes to be implemented in real time, further increasing the efficiency of the drilling process.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A computer-assisted method for optimizing a drilling tool assembly, the method comprising:

defining a desired drilling plan;

determining current drilling conditions within a wellbore;

determining current drilling tool parameters of at least two drilling tool assembly components within the wellbore;

determining a wear potential of a component of the drilling tool assembly;

analyzing the current drilling conditions, the current drilling tool parameters, and the wear potential of a component using a processor located within the wellbore to define a base drilling condition;

comparing, using the processor, the base drilling condition to the desired drilling plan;

determining, using the processor, a drilling tool parameter to adjust to achieve the desired drilling plan;

transmitting instructions to adjust the drilling tool parameters of the drilling tool assembly components through an intelligent drilling string; and adjusting at least one drilling tool parameter of at least one of the two drilling tool assembly components based on the comparing the base drilling condition to the desired drilling plan.

2. The method of claim 1, wherein the determining, analyzing, comparing, and adjusting occurs in real time.

3. The method of claim 1, wherein the determining the drilling tool parameter to adjust comprises:

determining the drilling tool parameter to adjust to drill a segment of a wellbore with an optimized rate of penetration.

4. The method of claim 3, wherein the determining the drilling tool parameter to adjust further comprises:

determining an optimized drilling tool parameter based on the wear potential and the optimized rate of penetration that results in an optimized wear pattern.

5. The method of claim 1, wherein the determining the drilling tool parameter to adjust comprises:

determining an optimized drilling tool parameter to drill a segment of a wellbore with a desired well path trajectory.

6. The method of claim 5, wherein the determining the drilling tool parameter to adjust further comprises:

determining the optimized drilling tool parameter to drill the segment of a wellbore to mitigate drilling tool assembly damage while drilling a well with the desired well path trajectory.

7. The method of claim 1, wherein the determining the drilling tool parameter to adjust comprises:

determining an optimized drilling tool parameter to drill a segment of a wellbore to mitigate a destructive vibration condition.

8. The method of claim 1, wherein the analyzing, comparing, and determining the drilling tool assembly parameter to adjust is performed by an artificial neural network.

9. The method of claim 1, further comprising:

adjusting at least one drilling tool parameter of at least two drilling tool assembly components.

10. A computer-assisted method for optimizing a drilling tool assembly, the method comprising:

determining a wear potential of a component of the drilling tool assembly;

disposing a drilling tool assembly in a wellbore, the drilling tool assembly comprising an artificial neural network and an intelligent drill string;

drilling a portion of the wellbore;

determining current drilling conditions and current drilling tool parameters;

transmitting the current drilling conditions, current drilling tool parameters, and the wear potential to the artificial neural network with the intelligent drill string;

analyzing the current drilling conditions, the current drilling tool parameters, and the wear potential with the artificial neural network;

identifying first and second drilling tool assembly components to adjust;

determining, based on the analyzing, an optimized drilling tool parameter value for at least one of the first and second drilling tool assembly components; and adjusting a drilling tool parameter of at least one of the first and second drilling tool assembly components based on the determined optimized drilling tool parameter value.

11. The method of claim 10, wherein the analyzing comprises:

determining optimized operating parameters to drill a segment of the wellbore having an optimized rate of penetration and optimized wear.

12. The method of claim 11, wherein the analyzing further comprises:

determining the optimized operating parameters to maintain a planned well path trajectory.

13. The method of claim 12, wherein the analyzing further comprises:

determining the optimized operating parameters to decrease destructive vibrations.

14. The method of claim 13, wherein the analyzing further comprises:

determining the optimized operating parameters to mitigate drilling tool assembly damage.

15. The method of claim 14, wherein the determining the optimized drilling tool parameter value comprises:

comparing the drilling tool parameters of the first and second drilling tool assembly components.

16. The method of claim 15, further comprising:

adjusting at least one drilling tool parameter value of at least one of the first and second drilling tool assembly components based on the comparing the first and second drilling tool assembly components.

17. A drilling tool assembly comprising:

a first drilling tool assembly component;

a second drilling tool assembly component;

an intelligent drill string; and an artificial neutral network in communication with the first and second drilling tool assembly components, the artificial neural network comprising a processor and a storage medium, the artificial neural network comprising instructions for:

determining current drilling conditions;

determining current drilling tool assembly parameters;

analyzing the current drilling conditions and the current drilling tool assembly parameters; and controlling the first and second drilling tool assembly components to drill a desired wellbore, by transmitting the instructions through the intelligent drill string;

controlling the first and second drilling tool assembly components based on determining a rate of penetration of the drilling tool assembly;

determining a wear potential of a component of the drilling tool assembly;

determining the effect of adjusting the drilling tool assembly parameter on a well path trajectory; and determining the effect of adjusting the drilling tool assembly parameter on a vibration of the drilling tool assembly.

* * * * *